US009917371B2

(12) United States Patent
Vannatta et al.

(10) Patent No.: US 9,917,371 B2
(45) Date of Patent: Mar. 13, 2018

(54) MID FED TRAVELING WAVE ANTENNA AND A REPEATABLE CIRCUIT SEGMENT FOR USE THEREIN

(71) Applicant: Motorola Mobility LLC, Chicago, IL (US)

(72) Inventors: Louis J Vannatta, Crystal Lake, IL (US); Hugh K Smith, Palatine, IL (US)

(73) Assignee: Motorola Mobility LLC, Chicago, IL (US)

( * ) Notice: Subject to any disclaimer, the term of this patent is extended or adjusted under 35 U.S.C. 154(b) by 115 days.

(21) Appl. No.: 14/833,281

(22) Filed: Aug. 24, 2015

(65) Prior Publication Data

US 2017/0062941 A1 Mar. 2, 2017

(51) Int. Cl.
*H01Q 11/02* (2006.01)
*H01Q 11/04* (2006.01)
*H01Q 1/27* (2006.01)

(52) U.S. Cl.
CPC ..... *H01Q 11/04* (2013.01); *H01Q 1/273* (2013.01)

(58) Field of Classification Search
None
See application file for complete search history.

(56) References Cited

U.S. PATENT DOCUMENTS

2003/0017807 A1* 1/2003 Boman ..... H04L 25/0272 455/73
2005/0122265 A1* 6/2005 Gaucher ..... H01Q 1/38 343/700 MS
2009/0203333 A1* 8/2009 Jeffries ..... H04L 25/0276 455/91
2010/0239029 A1* 9/2010 Komori ..... H01Q 1/242 375/257
2012/0229998 A1* 9/2012 Kagaya ..... H01P 1/02 361/777
2014/0035701 A1* 2/2014 Hirabayashi ..... H01P 1/00 333/136

* cited by examiner

*Primary Examiner* — Trinh Dinh
(74) *Attorney, Agent, or Firm* — Watson Intellectual Property Group

(57) ABSTRACT

The present invention provides a mid fed traveling wave antenna, which includes a signal feed point including a pair of terminals adapted for receiving a differential signal. The mid fed traveling wave antenna further includes a first transmission line branch extending from the signal feed point in a first direction, and a second transmission line branch extending from the signal feed point in a second direction, where each of the first transmission branch and the second transmission branch is terminated by a reflective termination. In at least one embodiment, the first transmission line branch and the second transmission line branch each have a respective length, where the length of the second transmission line branch is different than the length of the first transmission line branch.

18 Claims, 3 Drawing Sheets

MID FED TRAVELING WAVE ANTENNA AND A REPEATABLE CIRCUIT SEGMENT FOR USE THEREIN

FIELD OF THE INVENTION

The present invention relates generally to a traveling wave antenna, and more particularly, to a traveling wave antenna including a plurality of sequential transmission line circuit segments, which include a substantially composite right left handed transmission line circuit structure.

BACKGROUND OF THE INVENTION

Electronic devices referred to as wearables, such as new watches, which a wearer can use to interact with a nearby devices and/or communication networks are becoming increasingly desirable. Like cellular telephones before them, wearables are also becoming increasingly capable. In some instances, the increased capabilities are intended to support a cellular telephone's functionality. In other instances, the wearable is intended to replace some of the cellular telephone functionality. To the extent that the wearable is intended to replace some of the cellular telephone functionality, it may be necessary to replicate in the wearable device at least some of the corresponding components that support the replaced functionality in the cellular device.

However, wearables tend to be smaller than their counterparts, and while many aspects of the device with which a wearable may interact are themselves trending smaller, the wearables are often even smaller. That means, less room for power storage, less room for user interfaces, and less room for circuitry including less room for antennas. However, while there is less room for antennas in the wearable, such as the body of a watch, a watch strap can provide an opportunity for the placement of a corresponding antenna. Nevertheless, the space available in a watch band is not infinite. So, not only is there a desire to manage the antenna in the available space constraints, which may be somewhat relaxed by placement in a watch strap, there is a desire to design and incorporate power efficient antennas to help conserve the power, that may be available from the generally more limited wearable supply.

The present inventors have correspondingly recognized that an antenna involving transmission line elements can be modified through its overall construction, as well as an adjustment of its feed point relative to its transmission line structure, in order to provide an antenna that fits within a wristband construction, as well as provide for enhanced efficiency with improved return losses.

SUMMARY OF THE INVENTION

The present invention provides a mid fed traveling wave antenna, which includes a signal feed point including a pair of terminals adapted for receiving a differential signal. The mid fed traveling wave antenna further includes a first transmission line branch extending from the signal feed point in a first direction, and a second transmission line branch extending from the signal feed point in a second direction, where each of the first transmission branch and the second transmission branch is terminated by a reflective termination.

In at least one embodiment, the first transmission line branch and the second transmission line branch each have a respective length, and where the length of the second transmission line branch is different than the length of the first transmission line branch.

In at least a further embodiment, the length of each of the branches is selected such that the reflected signal from the first branch when it returns to the feed point will sum at the feed point with the reflected signal from the second branch when it returns to the feed point in a manner which substantially resists a return of power to the feed.

The present invention further provides a repeatable circuit segment for use in a mid fed traveling wave antenna. The repeatable circuit segment includes a pair of modified composite right left handed transmission line structure segments, where each modified composite right left handed transmission line structure segment includes a pair of transmission line segments. Each of the transmission line segments includes a pair of opposite side conductors, a discrete shunt inductor, which couples a first one of the pair of opposite side conductors to a second one of the pair of opposite side conductors, and a discrete series capacitor in one of the two opposite side conductors, wherein the discrete series capacitor that would normally be present in each of the opposite side conductors of an unmodified composite right left handed transmission line structure segment has been consolidated on one of the pair of opposite side conductors, and wherein adjacent modified composite right left handed transmission line structure segments have the discrete series capacitors consolidated on a different one of the pair of opposite side conductors.

These and other objects, features, and advantages of this invention are evident from the following description of one or more preferred embodiments of this invention, with reference to the accompanying drawings.

DETAILED DESCRIPTION OF THE PREFERRED EMBODIMENT(S)

Figure 1:
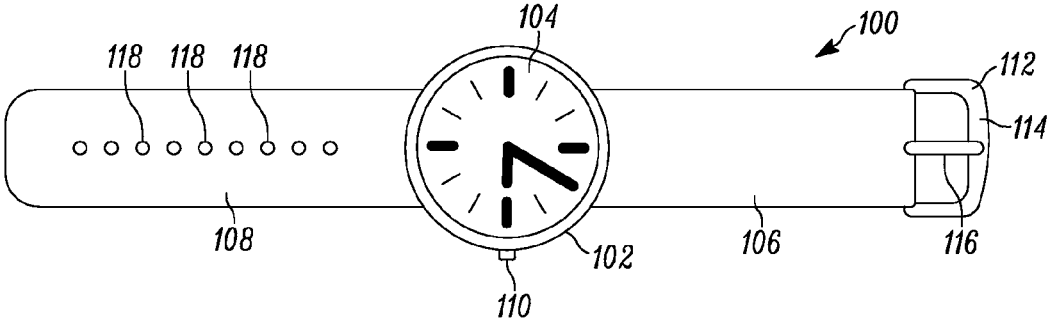
FIG. 1 is a front view of an exemplary wearable device, such as a smartwatch.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated. One skilled in the art will hopefully appreciate that the elements in the drawings are illustrated for simplicity and clarity and have not necessarily been drawn to scale. For example, the dimensions of some of the elements in the drawings may be exaggerated relative to other elements with the intent to help improve understanding of the aspects of the embodiments being illustrated and described.

FIG. 1 illustrates a front view of an exemplary wearable device, such as a smartwatch 100. In many ways, visually, the device is not that different from a more traditional watch. In the illustrated embodiment, the smartwatch 100 includes a main body 102 including a watch face 104, and a pair of watch band segments 106 and 108, which extend from the main body 102. In at least some instances, the watch face 104 will be reproduced as an image on a round display, which is located on the front of the main body 102. In some of these instances, the round display forming the watch face will include a touch sensitive interface for interacting with displayed elements. In the illustrated embodiment, the main body additionally includes a knob 110, which can function as a user actuatable button.

One watch band segment 106 includes a strip of material and a buckle 112 having a frame 114 and a prong 116, which is located at the end of the strip of material. The other watch band segment 108 similarly includes a strip of material, but instead of a buckle 112, the other watch band segment 108 includes a sequence 118 of holes for selectively receiving the prong 116 of the buckle 112. Depending upon which hole is used for receiving the prong 116, the overall loop length of the watch band can be adjusted as the ends are brought together to form a loop. In the present embodiment, the watch band provides a location within which an antenna can be received for supporting wireless communication capabilities that can be included in the main body of the watch.

Figure 2:
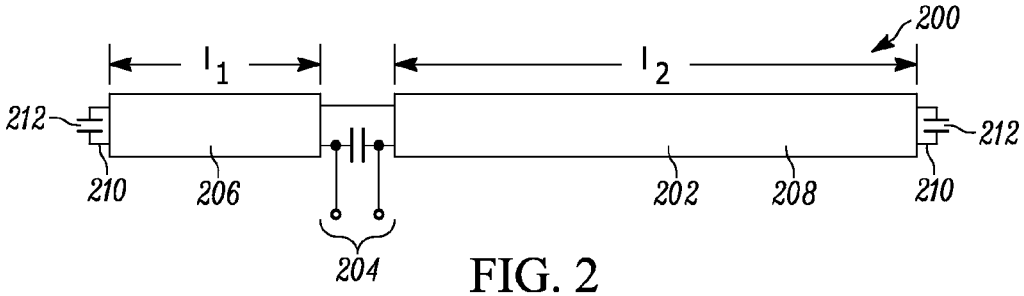
FIG. 2 is a block diagram of a mid fed traveling wave antenna.

FIG. 2 illustrates a block diagram 200 of a mid fed traveling wave antenna 202, in accordance with at least one embodiment. In the illustrated embodiment, the traveling wave antenna 202 includes a signal feed point including a pair 204 of terminals adapted for receiving a differential signal. The traveling wave antenna 202 additionally includes a first transmission line branch 206 extending from the signal feed point in a first direction, and a second transmission line branch 208 extending from the signal feed point in a second direction, which is different than the first direction. Each transmission line includes one or more transmission line unit cells coupled end to end in a sequence. In the illustrated embodiment, the length $l_2$ of the second transmission line 208 is different than the length $l_1$ of the first transmission line, where the second transmission line is longer than the first transmission line. This can be accomplished by the corresponding first and second transmission line branches, each being formed from a different number of transmission line unit cells being coupled together end to end in sequence. The first transmission branch and the second transmission branch are each terminated by a reflective termination 210, which may have the same or different structure and/or values. In the illustrated embodiment, the reflective termination, in each instance, includes a shunt capacitor 212. It is further possible that the reflective termination could include additional and/or alternative structure including an inductor or a conductor which shorts together the corresponding ends of the opposite side conductors. When a traveling wave arrives at the reflective termination, the traveling wave including the bulk of the corresponding energy is reflected back toward the signal feed point via the corresponding transmission line.

Figure 3:
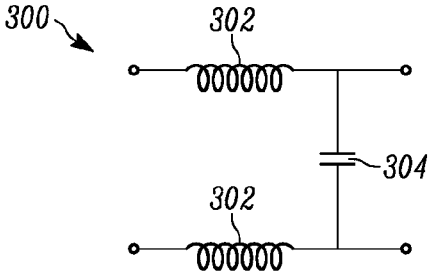
FIG. 3 is a circuit schematic of a balanced right handed transmission line unit cell.

FIG. 3 illustrates a circuit schematic of a balanced right handed transmission line unit cell 300. A right handed transmission line can be modeled as a periodic structure consisting of a series inductance 302 and a shunt capacitance 304, as illustrated. For all frequencies, a right handed transmission line will have a positive propagation constant. Such a structure in inherent in two parallel conductors, as a wire will have some series inductance, and the interaction between two parallel conductors will have a shunt capacitive effect.

Figure 4:
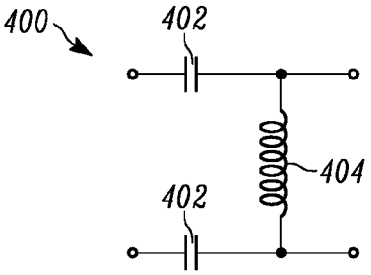
FIG. 4 is a circuit schematic of a balanced left handed transmission line unit cell.

FIG. 4 illustrates a circuit schematic of a balanced left handed transmission line unit cell 400. A left handed transmission line can be modeled as a periodic structure consisting of a series capacitance 402 and a shunt inductance 404, as illustrated. For all frequencies, a left handed transmission line will have a negative propagation constant. By combining the right handed transmission line unit cell 300 with the left handed transmission line unit cell 400, the amount that the right handed transmission line retards the phase can be offset by the amount that the left handed transmission line advances the phase.

Figure 5:
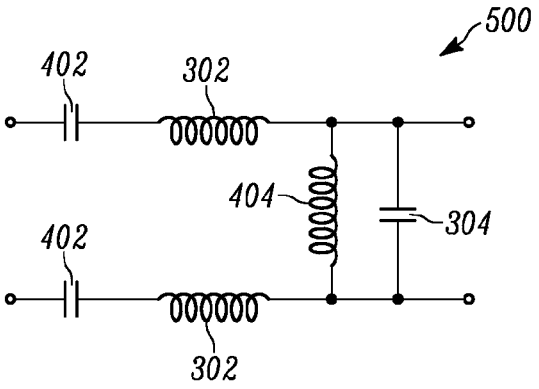
FIG. 5 is a circuit schematic of a balanced right left handed transmission line unit cell.

FIG. 5 illustrates a circuit schematic of a balanced right left handed transmission line unit cell 500, which includes both series inductance 302 and series capacitance 402, as well as shunt inductance 404 and shunt capacitance 304. By appropriately selecting the value of the components, there will be two pole frequencies at the point where the propagation constant ($\beta$) is zero, which corresponds to a resonating frequency of the shunt elements and a resonating frequency of the series elements. In the illustrated embodiment, there is a desire to use the antenna in support of Wi-Fi® or Bluetooth® at approximately 2.4 MHz, and the values of the components are selected accordingly. It may be further possible for a corresponding antenna structure to similarly support the reception of global positioning signals.

Figure 6:
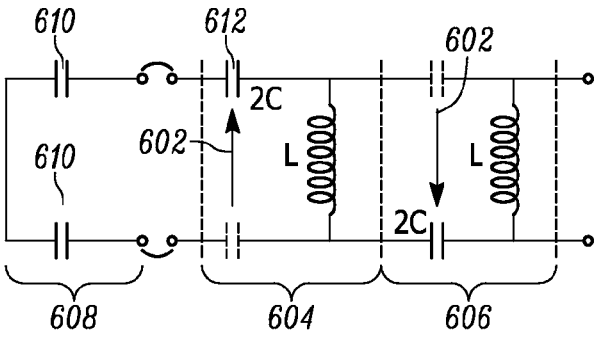
FIG. 6 is a circuit schematic of an adjacent pair of modified balanced right left handed transmission line unit cells.

While a globally balanced structure is illustrated, the present inventors have recognized that by introducing a localized imbalance into the structure, that the corresponding unit cells will radiate relatively more of the energy. FIG. 6 illustrates a circuit schematic of an adjacent pair 600 of modified balanced right left handed transmission line unit cells, which have been modified to produce a localized imbalance that is accounted for and negated in the adjacent cell, so as to preserve the overall group balance of the transmission line structure. More specifically, the present inventors have recognized that by shifting and consolidating 602 some of the series capacitance to alternative opposite side conductors in adjacent transmission line unit cells, one can create a localized imbalance, which enhances the ability of the circuit to convert the guided energy into a radiated form, but maintains the balanced nature of the overall structure. In the illustrated embodiment, the dashed lines separate each of the unit cells 604 and 606, and together the two cells form an adjacent pair of modified right left handed transmission line unit cells.

FIG. 6 further illustrates an exemplary reflective termination 608, which can be illustrated with a series capacitance 610. When the structure forming the transmission line is formed at the end of the transmission line branch, where the termination is located, the series capacitance 610 from the reflective termination can be combined or grouped with the series capacitance in the last modified right left handed transmission line unit cell in the sequence by forming a single larger capacitor.

The inventors have further recognized that by appropriately selecting the lengths of the two transmission line branches, one can reduce the return power to the feed. More specifically, the length of each of the branches is selected, such that the reflected signal from the first branch when it returns to the feed point will sum with the reflected signal from the second branch when it returns to the feed point in a manner which substantially reduces the return power to the feed point. This will allow the feed network to supply a signal into the traveling wave structure that when reflected back toward the feed point will resist leaving the circuit via the feed point, which results in more of the power being eventually dissipated inside the transmission line structures and correspondingly converted into radiated energy.

Figure 7:
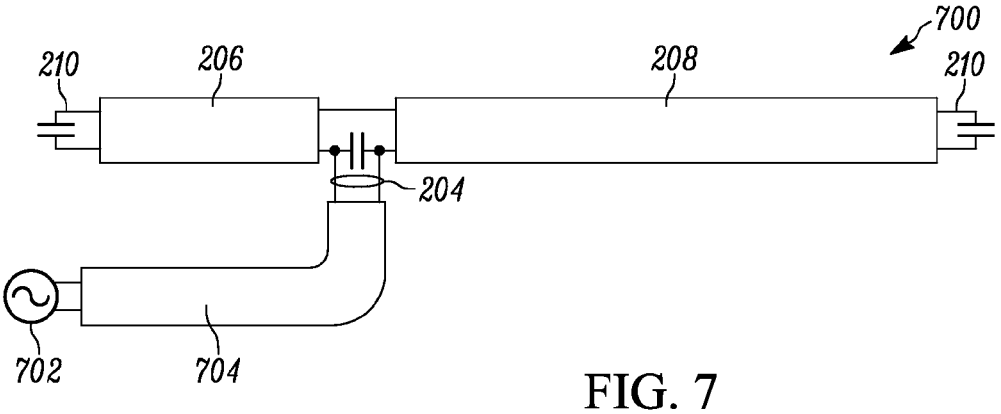
FIG. 7 is a block diagram of a mid fed traveling wave antenna, where the signal source is coupled to the feed points of the traveling wave antenna including multiple transmission line branches via a further transmission line section.

When an appropriate feed point is determined, an input impedance at the point where the two branches meet can be determined. A transmission line can then be used to match the input impedance at the signal source to the input impedance at the point where the two branches meet and the travelling wave antenna is fed to help facilitate more of the energy being transferred from the signal source into the multiple branch transmission line structure. FIG. 7 illustrates a block diagram 700 of a mid fed traveling wave antenna, where the signal source 702 is coupled to the pair of terminals 204 of the traveling wave antenna including multiple transmission line branches 206 and 208 via a further transmission line section 704. In the illustrated embodiment, the transmission line 704 which couples the signal source to the pair of terminals 204 converts a 50 ohm input signal to approximately a 20 ohm input signal.

Figure 8:
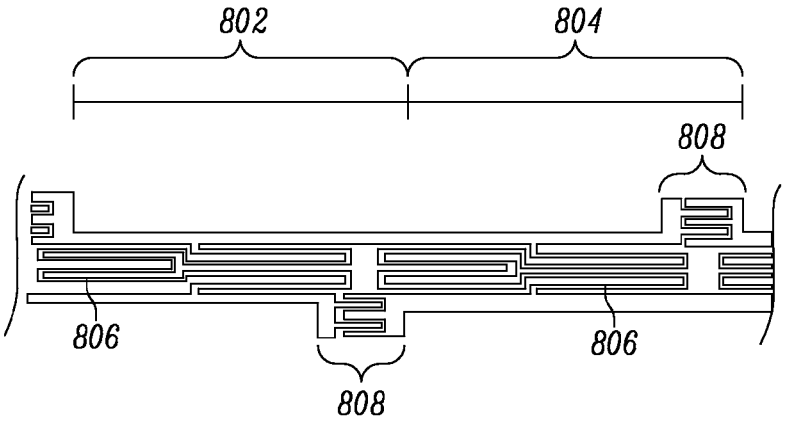
FIG. 8 is a partial conductive trace layout including an adjacent pair of modified balanced right left handed transmission line unit cells.

One of the aspects of the present structure is that it can be crafted using conductive traces on a circuit substrate. Inductors can be formed via an increased meandering trace length, and capacitors can be formed through two traces coming within close proximity. FIG. 8 illustrates a partial conductive trace layout 800 including an adjacent pair 802 and 804 of modified balanced right left handed transmission line unit cells, in accordance with at least one embodiment. In the illustrated embodiment, each unit cell is shown with a shunt inductor 806, and a corresponding series capacitor 808, which is aggregated on alternative ones of the opposite side conductors. In at least one embodiment, the length of the cell is approximately 12 mm. In the illustrated embodiment, the conductive traces used to form the capacitors, inductors and interconnections are designed so as to be present in a single plane, without the need for any vias or any trace structures on any additional or alternative planer surfaces.

In at least some instances, it may be beneficial to include a separate planer conductive layer that is located between the layer containing the conductive traces forming the transmission line structures including the corresponding inductors and capacitors, and the wrist of the user. The separate planer conductive layer and the layer containing the conductive traces forming the transmission line structures is separated by a dielectric, which in at least some instances can include a generally nonconductive material interspersed between the two layers. In some instances an air gap will also function as a dielectric. The planer conductive layer provides a better defined boundary condition.

Figure 9:
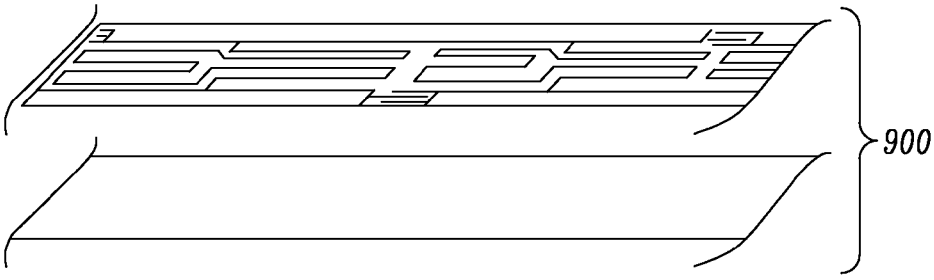
FIG. 9 is a stack up of multiple conductive layers including a partial conductive trace layout of multiple adjacent modified balanced right left handed transmission unit cells, illustrated in FIG. 8, and a partial plane conductor.

While it is desirable for the planer conductive layer to be positioned below the layer that has the conductive trace layout, since the planer conductive layer is not making direct physical contact with any of the elements in the conductive trace layer, the two layers have greater freedom to move and flex relative to one another. This allows the two layers to be allowed to separately shift and flex with less overall degradation over time. Generally both layers will be present in the watch strap separated by a dielectric material, which may also be allowed to separately shift and flex. FIG. 9 illustrates a stack up 900 of multiple conductive layers including a partial conductive trace layout of multiple adjacent modified balanced right left handed transmission unit cells, illustrated in FIG. 8, and a partial plane conductor.

Figure 10:
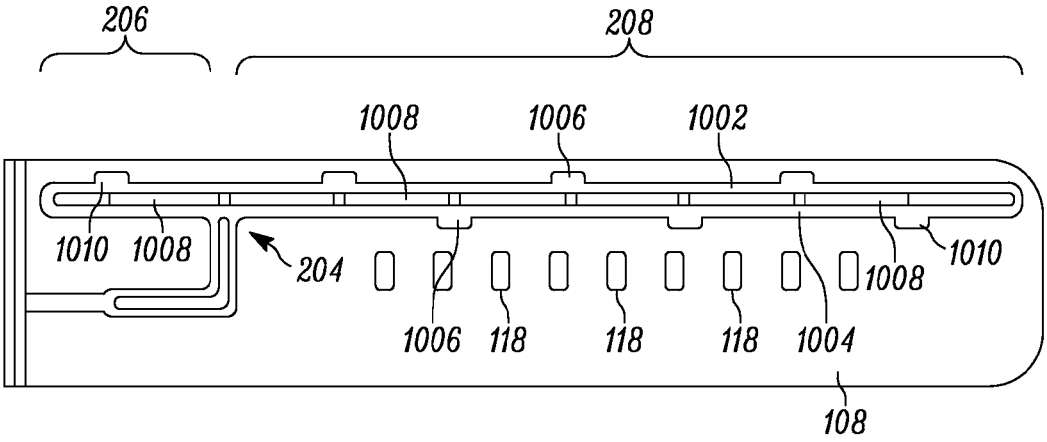
FIG. 10 is a conductive trace layout of a mid fed traveling wave antenna, in accordance with at least one embodiment, incorporated in a portion of a watch wristband.

FIG. 10 illustrates a conductive trace layout 1000 of a mid fed traveling wave antenna, in accordance with at least one embodiment, incorporated in a portion of a watch wristband. A determining factor which limits the length of the two branches is the length of the wristband portion in which the antenna is located. In the illustrated embodiment, the wristband section has a length of approximately 90 mm. In at least some embodiments, each transmission line unit cell has a length of approximately 12 mm. Such a size allows for the two branches together to include up to 7 transmission line unit cells. It has been appreciated that given the current structure that a more desirable return power loss at the feed point 204 can be achieved, if the first branch 206 is one transmission unit cell in length, and the second branch 208 is six transmission unit cells in length. In the illustrated layout, the bumps 1006 proximate the two opposite side conductors 1002 and 1004 correspond to the series capacitor 808 formed from trace layouts. More specifically, the bump represents an expanded layout area in the layer containing the conductive traces forming the transmission line structures, which is devoted to forming the corresponding capacitor. Furthermore a rectangular space 1008 between the two opposite side conductors correspond to the location of the shunt inductors 806 formed from trace layouts. The larger bumps 1010 (i.e. expanded layout areas) proximate the ends of each of the two branches correspond to a capacitor having an increased value, which includes the corresponding series capacitor, as well as the capacitor associated with the reflective termination.

While the preferred embodiments of the invention have been illustrated and described, it is to be understood that the invention is not so limited. For example, while the present preferred embodiment illustrates the differential signal being applied to a signal feed point which includes multiple points corresponding to the same one of the pair of conductors forming the transmission line, which is sometimes referred to as being series fed, the differential signal could be alternatively applied to a signal feed point which includes multiple points respectively corresponding to opposite ones of the pair of conductors forming the transmission line, which is sometimes referred to as being parallel fed, without departing from the teachings of the present invention. Numerous other modifications, changes, variations, substitutions and equivalents will occur to those skilled in the art without departing from the spirit and scope of the present invention as defined by the appended claims.

What is claimed is:

1. A mid fed traveling wave antenna comprising a transmission line antenna having a first end, a second end, and a length corresponding to a distance between the first end and the second end, the transmission line antenna including:

a signal feed point including a pair of terminals adapted for receiving a differential signal, the signal feed point being located along the length of the transmission line antenna a distance away from each of the first end and the second end of the transmission line antenna;

a first transmission line branch extending from the signal feed point to the first end of the transmission line antenna in a first direction; and a second transmission line branch extending from the signal feed point to the second end of the transmission line antenna in a second direction; and wherein each of the first transmission branch and the second transmission branch is terminated by a reflective termination at the respective first end and second end of the transmission line antenna.

2. A mid fed traveling wave antenna in accordance with claim 1, wherein the first transmission line branch and the second transmission line branch each have a respective length, and where the length of the second transmission line branch is different than the length of the first transmission line branch.

3. A mid fed traveling wave antenna in accordance with claim 2, wherein the first transmission line branch and the second transmission line is formed from one or more transmission line unit cells coupled end to end in a sequence, where the reflective termination is coupled to the end of the last transmission line unit cell in each of the branches, and where the difference in length between the first transmission line branch and the second transmission line branch is the result of a different number of transmission line unit cells being in each branch.

4. A mid fed traveling wave antenna in accordance with claim 3, wherein each of the one or more transmission line unit cells is a composite right left handed transmission line structure.

5. A mid fed traveling wave antenna in accordance with claim 4, wherein the composite right left handed transmission line structure forming each transmission line unit cell includes a series capacitor element, wherein every other series capacitor elements in the sequence of composite right left handed transmission line structure has been displaced to an opposite side conductor, wherein the displacement of every other series capacitor element creates a localized signal imbalance.

6. A mid fed traveling wave antenna in accordance with claim 2, wherein the length of each of the branches is selected such that at a predetermined frequency a first reflected signal from the reflective termination of the first branch when the first reflected signal returns to the feed point will sum at the feed point with a second reflected signal from the reflective termination of the second branch when the second reflected signal returns to the feed point, so as to produce a reduced combined voltage differential which substantially resists a return of power to the feed point.

7. A mid fed traveling wave antenna in accordance with claim 6, wherein the difference in length between the first transmission line branch and the second transmission line branch corresponds to the difference in length necessary for a round trip signal in a longer of the two branches at the predetermined frequency to travel an additional amount relative to a round trip signal in a shorter of the two branches, such that when the respective round trip signals reach the feed point, a longer of the two traveling round trip signals forms a geometric inversion, where the longer traveling round trip signal is phase inverted, relative to a shorter of the two traveling round trip signals.

8. A mid fed traveling wave antenna in accordance with claim 1, wherein the second branch extends from the feed point in a direction that is substantially opposite to the direction that the first branch extends from the feed point.

9. A mid fed traveling wave antenna in accordance with claim 1, wherein each of the first transmission line branch and the second transmission line branch includes one or more discrete capacitors and inductors.

10. A mid fed traveling wave antenna in accordance with claim 9, wherein the discrete capacitors and inductors are each formed from one or more conductive traces formed on a substrate.

11. A mid fed traveling wave antenna in accordance with claim 10, wherein the discrete capacitors and inductors are substantially planer.

12. A mid fed traveling wave antenna in accordance with claim 1, wherein the signal feed point is coupled to a signal source through an impedance matching circuit.

13. A mid fed traveling wave antenna in accordance with claim 12, wherein the impedance matching circuit includes a further transmission line.

14. A mid fed traveling wave antenna in accordance with claim 1, wherein a conductive plane underlies both the first branch and the second branch of the mid fed traveling wave antenna.

15. A mid fed traveling wave antenna in accordance with claim 14, wherein the conductive plane that underlies both the first branch and the second branch of the mid fed traveling wave antenna is in a separate layer that is adjacent to but unattached from the layer in which the first branch and the second branch are located.

16. A mid fed traveling wave antenna in accordance with claim 1, wherein the antenna is incorporated into a watch band.

17. A mid fed traveling wave antenna in accordance with claim 16, wherein a combined length of the length of the first branch and the length of second branch is less than the length of the portion of the watch band in which the antenna is located.

18. A mid fed traveling wave antenna in accordance with claim 16, wherein the first branch and the second branch of the mid fed traveling wave antenna is formed in a conductive layer that is embedded inside the material forming the watch band.

* * * * *